US005414898A

United States Patent [19]

Gastaldi

[11] Patent Number: 5,414,898

[45] Date of Patent: May 16, 1995

[54] SLIDE TRACK FOR A CONNECTION OF TWO ELEMENTS

[75] Inventor: Silvio Gastaldi, Kesswil, Switzerland

[73] Assignee: Lista Kunstofftechnik AG, Dozwil, Switzerland

[21] Appl. No.: 49,725

[22] Filed: Apr. 20, 1993

[30] Foreign Application Priority Data

Apr. 21, 1992 [CH] Switzerland ..... 1285/92

[51] Int. Cl.[6] ..... E05D 11/10

[52] U.S. Cl. ..... 16/348; 16/345

[58] Field of Search ..... 16/345, 348

[56] References Cited

U.S. PATENT DOCUMENTS

| | | | |
|---|---|---|---|
| 1,707,511 | 4/1929 | Cornwell | 16/348 |
| 1,986,307 | 1/1935 | Wagner . | |
| 2,665,448 | 1/1954 | De Leonardis | 16/345 |
| 3,324,502 | 6/1967 | Gehrie | 16/345 |
| 4,925,223 | 5/1990 | Craft . | |

FOREIGN PATENT DOCUMENTS

| | | | |
|---|---|---|---|
| 1275436 | 10/1961 | France . | |
| 1115613 | 10/1961 | Germany . | |
| 462430 | 3/1951 | Italy | 16/348 |
| 313836 | 7/1929 | United Kingdom . | |
| 339026 | 12/1930 | United Kingdom . | |

*Primary Examiner*—P. Austin Bradley

*Assistant Examiner*—Chuck Y. Mah

*Attorney, Agent, or Firm*—Egli Interantional; Christa Hildebrand

[57] ABSTRACT

A slide track (6) interacts with a slide (8) arranged on a connecting rod (7), the slide track being arranged on one of the elements (1, 2, 3) and the connecting rod being articulated on the other element. As a result, two positions of the elements are determinable with respect to each other, one of them being defined by a catch. The slide track (6) has an elongated guide track (12) and a flexible strip (11). The catch is designed as a catch recess (9), which is located at the one end of the guide track (12). The other end of the guide track (12) forms with the flexible strip (11) a slit which can be varied in its width by elastic deformation of the strip (11), brought about by the slide (8). The guide track is preferably designed as a rising surface (12), which together with a lower strip (13) forms a clasp-shaped central part (14). An elongated basic strip runs under the guide track (12) and also the catch recess (9) to an outlet from the element. The catch recess (9) is bounded by a first, straight hook, which together with a second, curved hook forms a passage through which the slide (8) can go onto the basic strip (21). The outlet is located in a covering strip of the slide track (6), from which the second hook bends off.

17 Claims, 2 Drawing Sheets

SLIDE TRACK FOR A CONNECTION OF TWO ELEMENTS

FIELD OF THE INVENTION

The invention relates to a slide track for a connection of two elements with the help of a slide arranged on a connecting rod and interacting with the slide track, the slide track being arranged on the one element and the connecting rod being articulated on the other element, at least two positions of the elements being determinable with respect to each other by the interacting of the slide with the slide track and one of these positions being defined by a catch.

BACKGROUND OF THE INVENTION

Such slide tracks are used in particular in the furniture industry, on cases, in particular brief cases or the like. For example, the lid of a trunk is raised and fixed in this raised position. For this purpose, the corresponding connections between lid and trunk body are usually of a jointed design, a joint being used for example to make a sleeve fall and thus produce a fixed support between lid and trunk body. For releasing, the sleeve is then pushed upwards, so that the joint comes free again and can bend. As a result, the trunk is closed.

With other slide tracks, the connection between lid and trunk body is of a rigid design, a corresponding slide running along a guide track and, for holding the lid open, falling into a catch recess. Closing of the lid then becomes possible when a corresponding connecting rod between lid and trunk body is pulled, so that the slide runs out of the catch recess and back along the guide track into its position of rest. If, however, connecting rods are provided, in particular on both sides, two hands are required to raise the connecting rods out of their catch position. At the same time, the lid should also be held, which is not possible. For this reason, fingers are often pinched here because the lid falls shut.

SUMMARY OF THE INVENTION

The present invention is based on the object of eliminating these disadvantages and providing a slide track with which a lid can be opened without acting on the connecting rod, held in the open position and closed again.

To achieve this object, a slide track of the type specified at the beginning is characterised in that the slide track has an elongated guide track and a flexible strip and the catch is designed as a catch recess which is located at the one end of the guide track, whereas the other end of the guide track, remote from the catch recess, together with the flexible strip forms a slit which can be varied in its width by elastic deformation of the strip, brought about by the slide.

This means and has the effect that the slide runs on the guide track into the catch recess, in which position this element is then held. For returning the element into its position of rest, now the element simply needs to be raised a stage further, so that the slide runs out of the catch recess, it subsequently falling behind the catch recess and being able to slide back along a basic strip, described in more detail further below, until it reaches the flexible strip and forces its way there through the slit formed by the flexible strip and the guide track, so that it then comes to lie again above the guide track. This is an extremely simple sequence of movements which can be accomplished with just one hand, acting only on that element which is actually to be moved.

The guide track mentioned above is preferably designed as a rising surface, forming together with a lower strip a clasp-shaped central part. As a result, it slopes into the catch recess and forms there an abutment for the slide, whereas the lower strip together with the abovementioned basic strip bounds a track for returning the slide into its position of rest.

The flexible strip preferably comprises a run-on strip and an adjoining sliding strip, which runs approximately in a plane of the guide track, whereas the run-on strip engages under the central part or the guide track. The sliding strip is thus located approximately in the plane of the guide track and then bends off towards the run-on strip. Near this bend, the abovementioned slit is formed with the end of the guide track. Normally, the slit has a width which in any event is less than the diameter of the slide. Consequently, provided that it is located above the guide track or on the sliding strip, the slide runs over and beyond this slit. If, however, it comes from below, guided on the run-on strip, to the slit, this slit limits its movement until the slit has opened to a width such that the slide can run through the slit.

The run-on strip is preferably adjoined by an elongated basic strip, which runs under the guide track and also engages under the catch recess. As a result, good guidance of the slide under the guide track is ensured. The basic strip runs under the guide track and also under the catch recess, so that if the slide falls out or slides out of the catch recess the slide can fall onto this basic strip and then be guided along this basic strip.

At its end remote from the run-on strip and the flexible strip, the basic strip preferably leads to an outlet out of the element. This makes it possible for the slide on the one hand to be introduced conveniently into the guide track, on the other hand if desired to be removed from the guide track, in order to release one element from the other.

The catch recess is preferably bounded by a first hook, which together with a second hook and in extension of the guide track beyond the catch recess forms a passage for the slide, through which the slide can go onto the basic strip. This ensures that, after it is moved beyond the catch recess into the passage, the slide can then slide back easily in the opposite direction. In the case of this design, preferably the one hook is approximately straight and the other hook curved, in order to accomplish in extension of the guide track beyond the catch recess on the one hand an arresting of the slide which is distinctly tangible for an operator in front of the region of the passage for the slide, and on the other hand a guidance of the slide which is distinctly tangible for an operator in the region of the passage for the slide.

In this arrangement, the outlet is preferably located in a covering strip of the slide track, from which the second hook also bends off and which engages over the guide track. Consequently, the second hook runs away from the covering strip, in order to form together with the other hook the passage for returning the slide.

Preferably, the slide can be moved out of the catch recess against a flexible resistance of a securing element and, if appropriate, can be moved into the catch recess. In this arrangement, the securing element may preferably be designed as a flexible securing strip, which is arranged on a covering strip of the slide track approximately opposite the catch recess and together with the rising surface forms a constriction for the passing of the slide, it preferably being possible for the second hook and the flexible securing strip to be moulded on together as an integral part on the covering strip. Consequently, the slide must press away the securing strip in order to come out of the catch recess through the constriction or else, if appropriate, to go into the catch recess. Other designs of the securing element are also conceivable, for example as a securing cushion of foam etc. This achieves the effect that the slide does not move inadvertently out of the catch recess, but instead can only fall behind the catch recess and slide back along the basic strip when it is desired for the element to return from the one position, defined by the catch, into the other position.

Such a slide track is so versatile that its application possibilities cannot be described in full. Its simple construction is striking, production being possible with little expenditure. However, handling of the slide track according to the invention is superior to any known slide track.

Further advantages, features and details of the invention emerge from the following description of preferred exemplary embodiments and with reference to the drawing, in which:

DETAILED DESCRIPTION OF THE DRAWINGS

Figure 1:
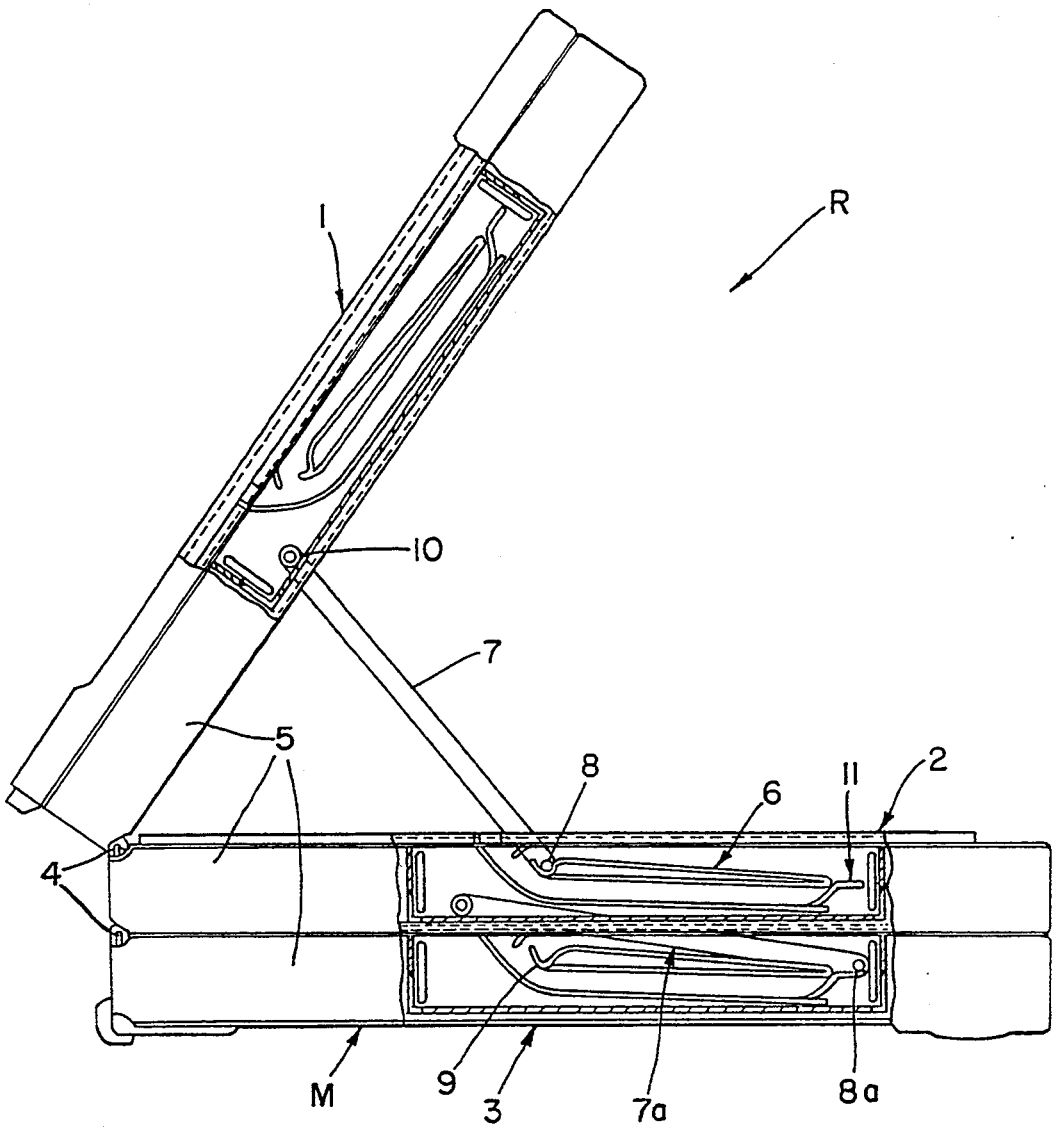
FIG. 1 shows a side view of an opened case with slide tracks according to the invention.

According to FIG. 1, a case R has a lid 1 and a lower part 3. A number of central parts 2 may be arranged in between. In the design represented in FIG. 1 as an example, two central parts 2 are provided, but the lid 1 could also be directly adjacent to the lower part 3.

In each case, two of these elements which are adjacent are connected to each other by means of a hinge 4, about which they can be pivoted in relation to each other. In the design represented in FIG. 1, the lid 1 is connected to a central part 2, which is connected to another central part 2 and the latter is connected to the lower part 3 by means of a respective hinge 4. As a result, the lid 1 can be raised by the one adjacent central part 2, the one central part 2 can be raised by the other adjacent central part 2, or the other central part 2 can be raised by the adjacent lower part 3, in order to make the content of the central part 2 or lower part 3 concerned accessible. Further parts of the case R are not described in any more detail since they are not essential for the invention.

Integrated into the side wall 5 of the central part 2 and of the lower part 3 there is in each case at least one slide track 6, which interacts with in each case a connecting rod 7 articulated on the element respectively lying above. In the lid 1 there is likewise articulated a connecting rod, but no slide track is integrated.

The connecting rod 7 is shown in a position for use in which the two central parts 2, connected by this connecting rod 7, are located in an opening position and are supported in a secured manner. This takes place by virtue of the fact that a slide 8, which is designed for example as a bolt fixed on one end of the connecting rod 7, is located in a catch recess 9 of the slide track 6 of the lower of the two connected central parts 2. At its other end, the connecting rod 7 is articulated by means of a pivot joint 10 on the side wall 5 of the upper of the two connected central parts 2 and connected, if appropriate releasably.

The connecting rod **7*a* is shown in a position for use in which the two elements connected by this connecting rod 7, namely the lower part 3 and the abovementioned lower of the two central parts 2, are located in a closing position. Here, the connecting rod 7*a* is thus articulated by means of a pivot joint 10 on the side wall 5 of the central part 2 just mentioned .and connected, if appropriate releasably, whereas the corresponding slide 8*a* is supported on a flexible strip 11, described in more detail further below, of that slide track 6 which is arranged on the lower part 3**.

Figure 2:
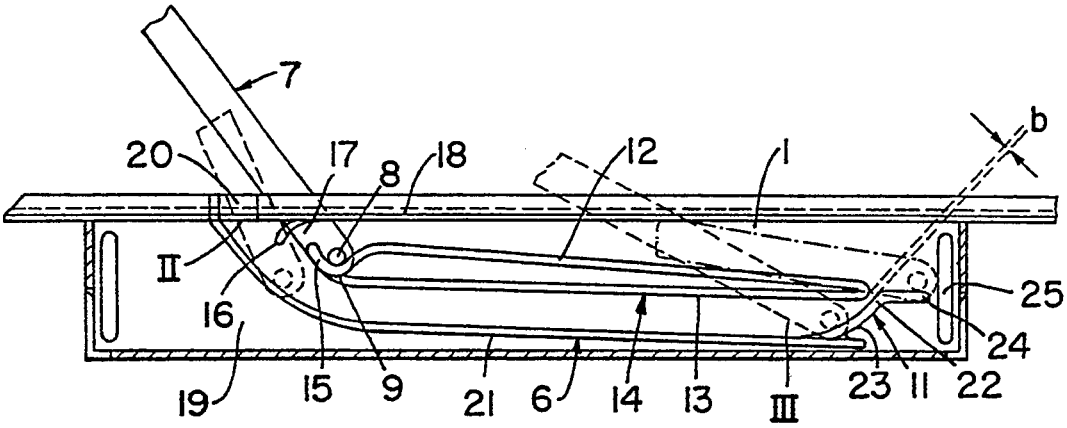
FIG. 2 shows an enlarged cutout from the case according to FIG. 1 in the region of the slide tracks.

The slide track 6 according to the invention is now to be explained in more detail with reference to FIG. 2. In particular, various stages of the interacting of the slide track 6 with the connecting rod 7, or the slide 8, are represented by dashed and dot-dashed lines.

The position of rest of the slide track 6 is identified by I. In this position of rest, the slide 8 rests on the flexible strip 11.

If then, for example, the upper of the two elements connected by the connecting rod 7 (element 1 or 2) is raised from the lower of the two elements (element 2 or 3), the slide 8 first of all runs for a while on part of the flexible strip 11, and then it slides along a guide track 12 which is designed as a rising surface and forms together with a lower strip 13 a clasp-shaped central part 14 of the slide track 6. Towards its end, the slide track 12 slopes towards the catch recess 9 and it is coupled or connected or operatively connected there to the lower strip 13. Together with the lower strip 13, after the catch recess 9, i.e. in extension of the guide track 12 beyond the catch recess 9, an upwardly directed first hook 15 is formed, which together with a downwardly directed second hook 16 forms a passage 17. The upwardly directed first hook 15 is approximately straight and the downwardly directed second hook 16 is curved.

This second hook 16 is integrally moulded onto a covering strip 18 of the slide track 6, which for its part also upwardly bounds a chamber 19 of the element 2 or 3, in which the slide track 6 and also the guided slide 8 are located. The second hook 16 protrudes downwards from the covering strip 18 approximately opposite the catch recess 9 and is at least partially designed as a flexible securing strip, in order to act as a securing element for the slide 8. Together with the guide track or rising surface 12, the second hook 16, or the part thereof acting as a securing strip, provides a constriction for the passing of the slide 8 just in front of the passage 17. In order to reach the passage 17, the slide 8 must first of all run through the said constriction, which takes place against the flexible resistance of the securing strip. Consequently, the slide 8 must press the hook or securing strip 16 flexibly away in order to come out of the catch recess 9, or else if appropriate to go into the catch recess 9, through the constriction.

The chamber 19 has only one outlet 20, which is arranged approximately in extension of the guide track beyond the catch recess and the second hook 16. Through this outlet 20, the slide 8 can be introduced into the chamber 19 and brought out again, so that the two elements considered can be connected to each other and released from each other by the connecting rod 7.

For closing the upper of the two elements onto the lower one, the upper element is raised, so that the slide 8 slides along the first hook 15 and is guided by the second, curved hook 16 against the flexible resistance of the securing strip out of the passage 17 in such a way that the connecting rod 7 is then located in the intermediate position, identified by II and represented by dashed lines. From then on, the connecting rod 7 no longer prevents the closing of the upper element onto the lower one, since the slide 8 can then run along a basic strip 21 until, at the end of the basic strip 21, it runs onto a run-on strip 25 of the flexible strip 11. This rub-on position is identified by III, the run-on strip 25 forming a stop for the slide 8 and, as a result, limiting the movement of the connecting rod 7.

The shape of the two hooks 15 and 16, together with the securing element, produces for the operator who is actuating the connecting rod 7 on the one hand a distinctly tangible arresting of the slide 8 in front of the region of the passage 17, on the other hand a distinctly tangible guidance of the slide 8 in the region of the passage 17 itself, in order that the said slide cannot inadvertently slide through the outlet 20 out of the element considered, but only when desired.

The flexible strip 11 together with the end of the clasp-shaped central part 14 more remote from the catch recess 9 forms a slit 22 which is variable in its width b, the slide 8 forcing itself into this slit 22 when running onto the flexible strip 11 and, as it does so, the flexible strip 11 yielding due to enlargement of the width b. As a result, the slide 8 can slide through the slit 22 and in this way go back into its position of rest I. After the slide 8 has passed through the slit 22, the latter closes again to the width b, so that when opening or raising the upper of the two elements from the lower one the slide 8 can slide away over this slit 22 and not undesirably go back downwards through the slit 22.

Accordingly, the entire flexible strip 11 comprises a sliding strip 24 which runs approximately in the plane of the rising surface 12 and the end of which lies in the vicinity of the run-on strip 25, and of a run-on strip 23 which adjoins this sliding strip 24, thereby forming the slit 22 with the central part 14, and itself is connected to the basic strip 21 and merges with the latter.

I claim:

1. Combined slide track, slide and connecting rod for releasably positioning two elements, said two elements being hinged to each other, the slide being arranged on the connecting rod and cooperating with the slide track, the slide track being arranged on one of the element and the connecting rod being articulated on the other element, at least two positions of the elements being determinable by the cooperation of the slide with the slide track and one of these positions being defined by a catch, the slide track having both, an elongated guide track and a flexible strip integrally formed on the slide track, the catch being designed as a catch recess located at one end of the guide track, whereas another end of the guide track, remote from the catch recess, together with the flexible strip forms a slit which can be varied in its width by elastic deformation of the strip, brought about by the slide.

2. Combined slide track, slide and connecting rod according to claim 1, wherein the guide track is designed as a rising surface and together with a lower strip forms a clasp-shaped central part.

3. The combined slide track, slide and connecting rod according to claim 2, wherein the flexible strip comprises a run-on strip and an adjoining sliding strip, which runs approximately in a plane of the guide track, whereas the run-on strip extends under the central part.

4. The combined slide track, slide and connecting rod according to claim 3, wherein the run-on strip is adjoined by an elongated basic strip, which runs under the guide track and also extends under the catch recess.

5. The combined slide track, slide and connecting rod according to claim 4, wherein in one of the elements, at an end of the basic strip, remote from the run-on strip and the flexible strip, the basic strip leads to an outlet from the element.

6. The combined slide track, slide and connecting rod according to claim 5, wherein the outlet is located in a covering strip of the slide track, from which strip a second hook also bends off and which extends over the guide track.

7. The combined slide track, slide and connecting rod according to claim 4, wherein the catch recess is bounded by a first hook, which together with a second hook and in extension of the guide track beyond the catch recess forms a passage for the slide, through which the slide can go onto the basic strip.

8. The combined slide track, slide and connecting rod according to claim 7, wherein the first hook is approximately straight and the second hook is curved.

9. The combined slide track, slide and connecting rod according to claim 7, wherein the second hook and a flexible securing strip are molded on together as an integral part on a covering strip.

10. The combined slide track, slide and connecting rod according to claim 2, further comprising a securing element and wherein the slide can be moved out of the catch recess against a flexible resistance of the securing element and can be moved into the catch recess.

11. Combined slide track, slide and connecting rod according to claim 10, wherein the securing element is designed as a flexible securing strip, which is arranged on a covering strip of the slide track approximately opposite the catch recess and together with the rising surface forms a constriction for the passing of the slide.

12. Combined slide track, slide and connecting rod for releasably positioning two elements, said two elements being hinged to each other, the slide being arranged on the connecting rod and cooperating with the slide track, the slide track being arranged on one of the element and the connecting rod being articulated on the other element, at least two positions of the elements being determinable by the cooperation of the slide with the slide track and one of said positions being defined by a catch, the slide track having both, an elongated guide track and a flexible strip integrally formed on the slide track, the catch comprises a catch recess located at one end of the guide track, whereas an other end of the guide track, remote from the catch recess, together with the flexible strip forms a slit which can be varied in its width by elastic deformation of the strip, brought about by the slide and wherein the guide track having a rising surface and together with a lower strip forms a clasp-shaped central part and wherein the flexible strip comprises a run-on strip and an adjoining sliding strip, which runs approximately in a plane of the guide track, whereas the run-on strip extends under the central part.

13. The combined slide track, slide and connecting rod as claimed in claim 12, wherein the run-on strip is adjoined by an elongated basic strip, which runs under the guide track and also extends under the catch recess.

14. The combined slide track, slide and connecting rod as claimed in claim 13, wherein at the end of the basic strip, remote from the run-on strip and the flexible strip, the basic strip leads to an outlet from one of the elements.

15. The combined slide track, slide and connecting rod as claimed in claim 13, wherein an outlet is located in a covering strip of the slide track, from which strip the second hook also bends off and which extends over the guide track.

16. The combined slide track, slide and connecting rod as claimed in claim 12, wherein the slide can be moved out of the catch recess against a flexible resistance of a securing element and can be moved into the catch recess and wherein the securing element is designed as a flexible securing strip, which is arranged on a covering strip of the slide track approximately opposite the catch recess and together with the rising surface forms a constriction for the passing of the slide.

17. The combined slide track, slide and connecting rod as claimed in claim 16, wherein the catch recess is bounded by a first hook, which together with a second hook and an extension of the guide track beyond the catch recess forms a passage for the slide, through which the slide can go onto a basic strip and wherein the second hook and the flexible securing strip are molded together as an integral part on the covering strip.

* * * * *